US006412778B1

(12) United States Patent
Alaimo

(10) Patent No.: US 6,412,778 B1
(45) Date of Patent: Jul. 2, 2002

(54) MULTI-LEVEL CHESSBOARD

(76) Inventor: Michael J. Alaimo, 1936 Seminole Dr., Agoura Hills, CA (US) 91301

( * ) Notice: Subject to any disclaimer, the term of this patent is extended or adjusted under 35 U.S.C. 154(b) by 0 days.

(21) Appl. No.: 09/574,023

(22) Filed: May 19, 2000

(51) Int. Cl.[7] ..... A63F 3/02
(52) U.S. Cl. ..... 273/261; D21/348; D21/241
(58) Field of Search ..... 273/260, 261, 273/236, 287, 280, 241; D21/334–397

(56) References Cited

U.S. PATENT DOCUMENTS

D221,390 S * 8/1971 Skillman ..... D21/1
D223,939 S * 6/1972 Palazzolo
D267,023 S * 11/1982 Bowser

* cited by examiner

*Primary Examiner*—Benjamin H. Layno
*Assistant Examiner*—Vishu Mendiratta

(57) ABSTRACT

A multi-level chessboard wherein the playing surface of the chessboard is divided into a first series of squares and a second series of squares with the second series of squares being of a color that contrasts to the color of the first series of squares. The squares are located at various heights forming a stepped configuration.

8 Claims, 1 Drawing Sheet

MULTI-LEVEL CHESSBOARD

BACKGROUND OF THE INVENTION

1. Field of the Invention

The field of this invention relates to games and more particularly to a new and novel configuration of chessboard for playing of the game of chess.

2. Description of the Prior Art

A chessboard is an extremely well known playing surface. A typical chessboard is planar and is divided into a plurality of equal sized squares with there being a first series of squares and a second series of squares with the first series of squares being of a color which contrasts to the second series of squares. Typical colors would be a black color for the first series of squares and a white color for the second series of squares. There are thirty-two in number of the first series of squares and thirty-two in number of the second series of squares. Not only is the chessboard used for the game of chess, but it is also commonly used for the game of checkers.

In the past, it has been known to reconfigure a chessboard so that it is not planar. An example would be a chessboard which has a slight concave configuration. The purpose of this reconfiguring the shape of the chessboard is to enhance the playing of the game of chess. However, in the past, the using of a chessboard other than of a totally planar configuration has not been accepted to any great degree.

SUMMARY OF THE INVENTION

A multi-level chessboard which utilizes a board that has a first playing surface and a second playing surface which are located on opposite sides of the board. The second playing surface is deemed to be conventional, is completely planar, and is divided into thirty-two squares of one color and thirty-two squares of another color with the squares of the different colors being arranged in a generally alternating arrangement. The chessmen are divided into different colors with generally one color of chessmen to match one of the colors of squares, and the other color of chessmen matches the other color of squares. The first playing surface of the chessboard has a similar arrangement of squares as the second playing surface with the exception that the flat squares are located at various heights with some squares being lower in height and other squares being higher in height. The highest in height squares are located at the four corners of the rectangularly shaped board. The reason for this is that when the chessboard is used in the conventional manner that these four squares can be located on planar surface, such as a table, and the second playing surface will then be located horizontal.

One of the primary objectives of the present invention is to construct a chessboard which creates a new dimension when playing the game of chess by having the different chess members located at various height positions on the chessboard.

Another objective of the present invention is to construct a chessboard which can be manufactured at a reasonable cost and thereby sold to the ultimate consumer at a reasonable cost.

BRIEF DESCRIPTION OF THE DRAWINGS

For a better understanding of the present invention, reference is to be made to the accompanying drawings. It is to be understood that the present invention is not limited to the precise arrangement shown in the drawings.

DETAILED DESCRIPTION OF THE PREFERRED EMBODIMENT

Figure 1:
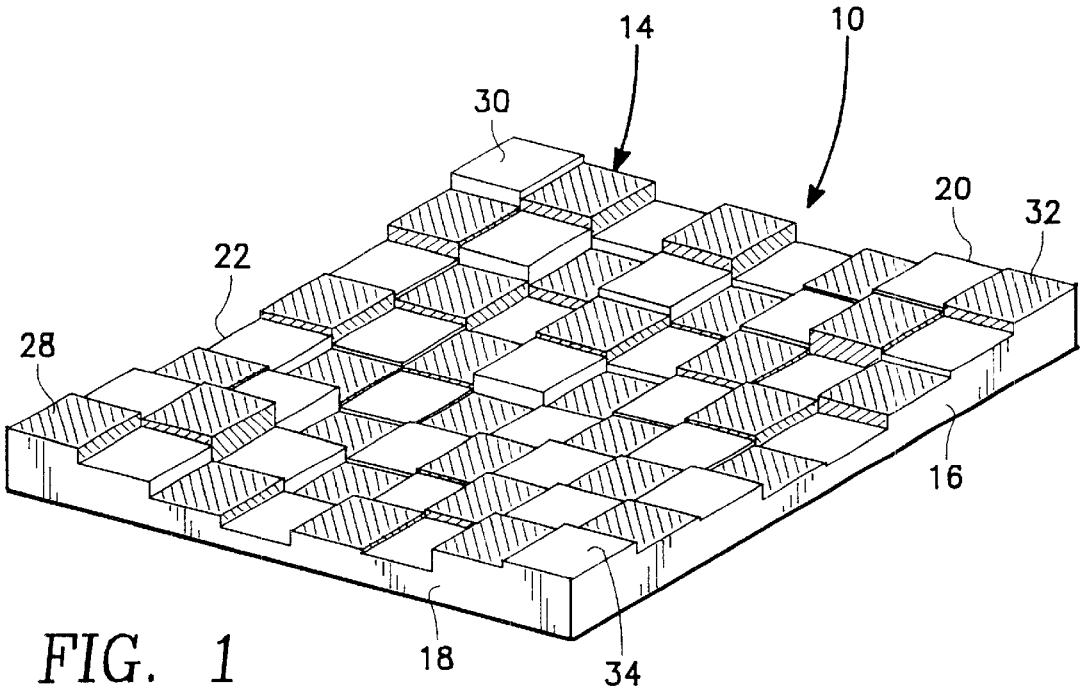
FIG. 1 is an isometric view of one surface of the chessboard wherein the squares of the chessboard are arranged in a various height random pattern.
Figure 2:
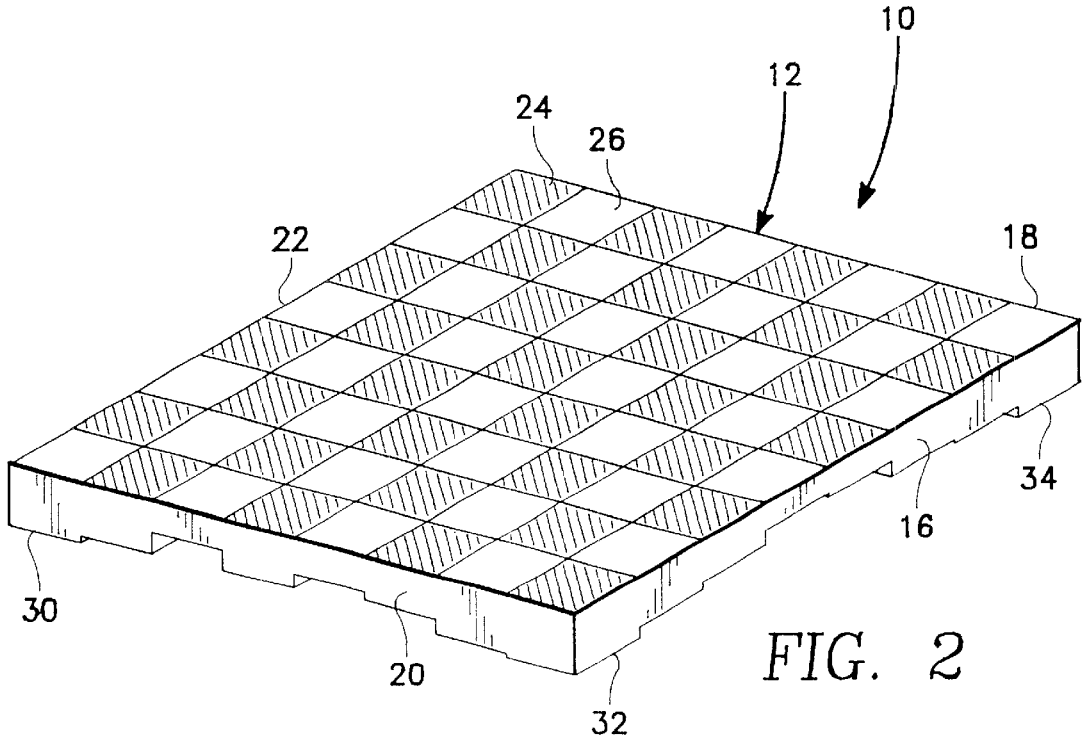
FIG. 2 is an isometric view of the opposite surface of the chessboard which is a conventional planar playing surface.

Referring particularly to the drawing, there is shown the multi-level chessboard 10 of this invention. The chessboard 10 is basically rectangular in configuration and has a first playing surface 12 and a second playing surface 14. The first playing surface 12 is on one side of the chessboard 10 with the second playing surface 14 being on the opposite side of the chessboard 10. The chessboard 10 has side edges 16, 18, 20 and 22 which are located between the surfaces 12 and 14. Each of the side edges 16–22 are planar with directly adjacent side edges 16–22 being located perpendicular.

The second playing surface 12, which is planar or flat, is divided into a plurality of first squares 24 and second squares 26. All the squares 24 and 26 are of the same size. There are thirty-two in number of the first squares 24 and thirty-two in number of the second squares 26. The first squares 24 are of a darker color than the second squares 26 so that there is a contrast between the two. A typical chessboard or checkerboard is constructed in precisely this arrangement of squares 24 and 26. The second playing surface 12 could be utilized to play chess or checkers by placing of the first surface 14 directly against a supporting surface, which is not shown. A typical supporting surface would be a table. When the second playing surface 12 is being used in order to play a game, the corner squares 28, 30, 32 and 34 of the first playing surface 14 are placed on the supporting surface. The corner squares 28–34 are all of the same height so that the planar surface of the second playing surface 12 will be located horizontal.

When observing of the first playing surface 14, the different color configuration of the squares 24 and 26 is apparent. What is also apparent is that the first playing surface 14 is not planar, that there is a wide variance of different heights of the squares 24 and 26 within this surface 14. When playing a game of chess on the surface 14, as the chessmen are moved across the surface 14, the fact that the men occupy different height positions when a chessman is located on one of the squares 24 or 26, provides for an additional dimension in the playing of the game. It is noted that some squares 24 and 26 are quite deep or of less height than other squares. The corner squares 28–32 have the greatest height. There is no particular pattern in the varying of the height of the squares 24 and 26 as such variance is merely selected randomly. In the constructing of the chessboard 10, the first playing surface 14 of one chessboard 10 may have a variation in height of the squares 24 and 26 which is different from every other similar type of chessboard 10.

The philosophy of the present invention is that when playing chess, the board becomes a battlefield because of the multiple levels on which the different chess pieces are located. The different levels impart to the players a feeling of a "real battle" of fighting a battle on three-dimensional terrain.

The present invention may be embodied in other specific forms without departing from the essential attributes thereof. Reference should be made to the appending claims rather than the foregoing specification as indicating the scope of the invention.

What is claimed is:

1. A multi-level chessboard comprising:

a board having a first playing surface and a second playing surface, said first playing surface being located on an opposite side of said board from said second playing surface, said first playing surface being divided into a plurality of first squares with there being a first series at a first color and a second series at a second color with said second color contrasting to said first color, said plurality of first squares being further divided into a first series of squares of equal height to form a stable base for said second playing surface and a second series of squares being arranged at random heights relative to each other forming an asymmetrical stepped configuration to simulate natural terrain.

2. The multi-level chessboard as defined in claim 1 wherein:

said first series of squares of equal height on said first playing surface are planar and are divided into a first series of a first color and a second series of a second color.

3. The multi-level chessboard as defined in claim 1 wherein:

said plurality of said first squares of equal height are located at each corner of said board.

4. The multi-level chessboard as defined in claim 1 wherein:

each of said first squares being flat.

5. The multi-level chessboard as defined in claim 1 wherein:

said first squares all being of the same size.

6. The multi-level chessboard as defined in claim 5 wherein:

each of said first squares being flat.

7. The multi-level chessboard as defined in claim 6 wherein:

said first squares including corner squares with there being a said corner square located at each corner of said board, with two of said corner squares being of said first color.

8. The multi-level chessboard as defined in claim 7 wherein:

said second playing surface being planar and being divided into a s series of second squares similar to said first squares.

* * * * *

UNITED STATES PATENT AND TRADEMARK OFFICE

CERTIFICATE OF CORRECTION

PATENT NO. : 6,412,778 B1
DATED : July 2, 2002
INVENTOR(S) : Michael J. Alaimo

It is certified that error appears in the above-identified patent and that said Letters Patent is hereby corrected as shown below:

Column 2,
Lines 3 and 6, under BRIEF DESCRIPTION OF THE DRAWINGS, the word "isometric" should read -- asymmetrical --.

Signed and Sealed this

Third Day of December, 2002

JAMES E. ROGAN
*Director of the United States Patent and Trademark Office*